US010995555B2

(12) United States Patent
LeBaron et al.

(10) Patent No.: US 10,995,555 B2
(45) Date of Patent: May 4, 2021

(54) DOWNHOLE VIBRATORY TOOL WITH FLUID DRIVEN ROTOR

(71) Applicant: Phoenix Drill Tools, Inc., Salt Lake City, UT (US)

(72) Inventors: Devin D. LeBaron, Salt Lake City, UT (US); Matthew H. Taylor, Salt Lake City, UT (US)

(73) Assignee: Phoenix Drill Tools, Inc., Salt Lake City, UT (US)

( * ) Notice: Subject to any disclaimer, the term of this patent is extended or adjusted under 35 U.S.C. 154(b) by 0 days.

(21) Appl. No.: 16/276,813

(22) Filed: Feb. 15, 2019

(65) Prior Publication Data

US 2019/0277092 A1 Sep. 12, 2019

Related U.S. Application Data

(60) Provisional application No. 62/631,081, filed on Feb. 15, 2018.

(51) Int. Cl.
*E21B 7/24* (2006.01)
*E21B 4/02* (2006.01)
(Continued)

(52) U.S. Cl.
CPC ..... *E21B 7/24* (2013.01); *E21B 4/02* (2013.01); *E21B 28/00* (2013.01); *E21B 43/003* (2013.01)

(58) Field of Classification Search
CPC . E21B 7/24; E21B 4/02; E21B 43/003; E21B 28/00; E21B 31/005
See application file for complete search history.

(56) References Cited

U.S. PATENT DOCUMENTS 4,682,896 A 9/1987 Halilovi
4,824,258 A 4/1989 Bodine
(Continued)

FOREIGN PATENT DOCUMENTS

CA 23195779 A1 6/2000
CN 103132940 A 6/2013
WO 2019/161158 A1 8/2019

OTHER PUBLICATIONS (ISA/US) "Notification of Transmittal of the International Search Report and the Written Opinion of the International Searching Authority, or the Declaration," PCT/US19/18151, dated May 23, 2019.

(Continued)

*Primary Examiner* — Nicole Coy
*Assistant Examiner* — Jonathan Malikasim
(74) *Attorney, Agent, or Firm* — Bretton L. Crockett; Tech Law Ventures, PLLC

(57) ABSTRACT

Downhole vibratory tools that use fluid flow to reciprocate a rotor in a vibration chamber and associated methods and processes. In a first illustrative embodiment, an elongated external housing allows connection to a drillstring, behind a downhole drill. From a top sub, fluid flows through a first flow plate and spiral flow chamber to enter a central vibration chamber in a spiral direction and exits the vibration chamber through a counterpart second flow plate and spiral flow chamber. A rotor is disposed in the vibration chamber. The spiral flow through the vibration chamber causes the rotor to reciprocate around the vibration chamber, thereby creating vibrations that are transmitted to the drillstring. Methods of use include deploying the vibration tool to improve rates of penetration and enhances reach by creating resonance vibrations against the wall of a wellbore to effectively break static friction.

20 Claims, 2 Drawing Sheets

(51) Int. Cl.
*E21B 43/00* (2006.01)
*E21B 28/00* (2006.01)

(56) References Cited

U.S. PATENT DOCUMENTS 7,559,362 B2 * 7/2009 Miner ..... E21B 43/006
166/105
2014/0216727 A1 8/2014 Kasyanov et al.

OTHER PUBLICATIONS

Machine translation of Chinese Publication No. 103132940A.

* cited by examiner

DOWNHOLE VIBRATORY TOOL WITH FLUID DRIVEN ROTOR

CROSS-REFERENCE TO RELATED APPLICATION

This application claims the benefit of U.S. Provisional Application No. 62/631,081, filed Feb. 15, 2018, which is incorporated herein by reference in its entirety, including but not limited to those portions that specifically appear hereinafter.

TECHNICAL FIELD

The present disclosure relates to downhole tools for drillstrings and to downhole vibratory tools.

BACKGROUND

Downhole vibratory tools that generate pressure pulses using fluid cavitation or spools that move in line with a long axis of the tool for extended reach drilling in open hole or reducing friction against a casing are known. Acoustic radiator tools for coal bed methane production, such as that disclosed in US 2014/0216727 use a hollow shaft to generate opposing flows through an orbital bushing to cause rotation around the shaft and thereby create sound waves. Testing of such an acoustic radiator tool for suitability for extended reach application in cased hole resulted in the tool breaking due to the higher flow pressures and volumes.

A system or device that was able to use fluid flow to create vibratory movement of a rotor to create vibrations suitable for extended reach wellbore use or drilling enhancement in open hole would be an improvement in the art.

SUMMARY

The present disclosure is directed to a downhole vibratory tool that uses fluid flow to reciprocate a rotor in a vibration chamber. In a first illustrative embodiment, an elongated external housing allows connection to a drillstring, behind a downhole drill. From a top sub, fluid flows through a first flow plate and spiral flow chamber to enter a central vibration chamber in a spiral direction and exits the vibration chamber through a counterpart second flow plate and spiral flow chamber. A rotor is disposed in the vibration chamber. The spiral flow through the vibration chamber causes the rotor to reciprocate around the vibration chamber, thereby creating vibrations that are transmitted to the drillstring.

Transmission of the vibrations created by such a tool to the drillstring have been shown to improve results in a number of drilling applications. In the case of exploratory core drilling, deploying the vibration tool in the downhole core retrieval assembly has been shown to improve rate of penetration as it assists with clearance of cuttings from the bit face to allow the drill bit to consistently make contact with virgin rock. Further, such tools have been shown to improve penetration and core recovery in broken or incompetent ground. Yet another application for these tools is to enhance reach of a drill-string both inside cased wellbore and open hole. The vibration creates a resonance against the wall of the wellbore to effectively break static friction of the drillstring against the wellbore and allows the drillstring to be more easily deployed in extended reach applications. Such methods of operating or using these tools are within the scope of the present disclosure.

DESCRIPTION OF THE DRAWINGS

It will be appreciated by those of ordinary skill in the art that the drawing is for illustrative purposes only. The nature of the present disclosure, as well as other embodiments in accordance with this disclosure, may be more clearly understood by reference to the following detailed description, to the appended claims, and to the drawing.

DETAILED DESCRIPTION

It will be appreciated by those skilled in the art that the embodiments herein described, while illustrative, are not intended to so limit this disclosure or the scope of the appended claims. Those skilled in the art will also understand that various combinations or modifications of the embodiments presented herein can be made without departing from the scope of this disclosure. All such alternate embodiments are within the scope of the present disclosure.

Figure 1:
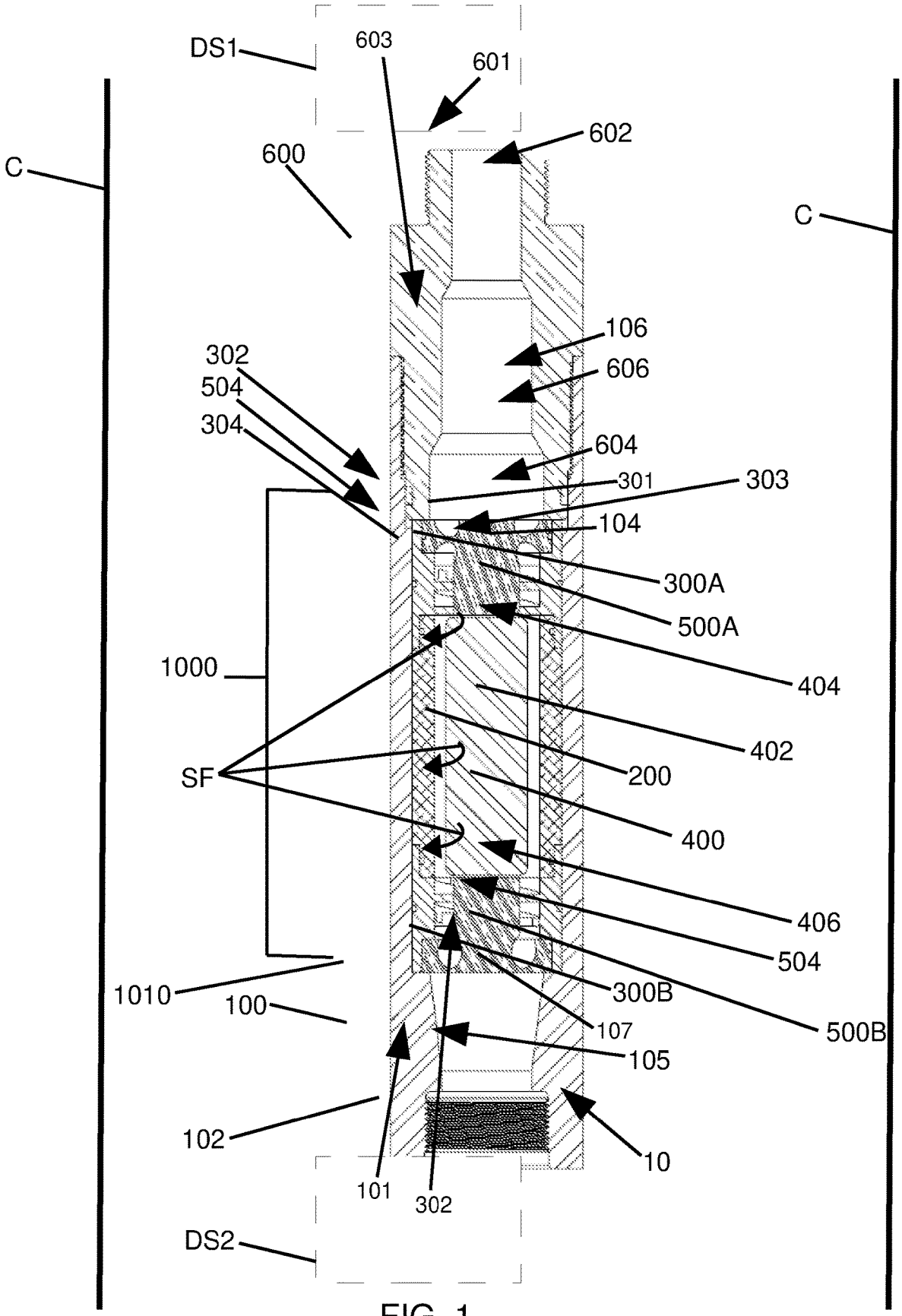
FIG. 1 is a sectional side view of a first embodiment of a downhole vibratory tool in accordance with the teaching of the present disclosure, showing the structural details thereof.

Turning to FIG. 1, a first illustrative embodiment of a downhole vibratory tool 10 that uses fluid flow to reciprocate a rotor in a vibration chamber. In a first illustrative embodiment, beginning at the upstream end of the tool 10, a top sub assembly 600 has a central bore 603 that opens from central top opening 601, surrounded by external threads 602 to allow for attachment to an upstream fitting or tool (generically indicated at DS1) in a drillstring assembly. Moving downstream, the central bore 603 may increase in diameter to obtain particular flow rates at a lower end. As depicted, this may be accomplished by having multiple transition zones to relatively larger bore segments. An external portion of the lower sidewall of the top sub 600 may include threading 606 for attachment to the housing 100.

The elongated external housing 100 is similarly formed as a tube having a central bore 101. A central portion 104 of the central bore may have a surrounding sidewall with a round cross-sectional shape that appears as parallel sidewalls in the sectional view of FIG. 1, which are spaced apart and form a portion of the vibration assembly 1000. Upstream, the housing may include an internally threaded portion 106 that corresponds to threading 606 for connection to the top sub 600. Central portion 104 may end at an offset 107 formed as rim around the central bore, which may serve as an abutment surface as discussed below. Continuing downstream, the central bore may narrow at offset 107 as an extended lower portion 105 of central bore 103 and continue to an internally threaded distal portion 102 for connection to a downstream tool, such as a drill head. The connections between top sub 600 and housing 100 may be sealed to prevent leakage, as by placement of suitable O-rings or other seals in the depicted recess 604.

An upper flow plate 300A is disposed in the housing 100 downstream of top sub 600 and forms the upper or proximal end of the vibration assembly 1000. Upper flow plate 300A may have a generally planar upper surface and a recessed lower stem 304, formed as a column extending beneath the upper surface. The generally planar upper surface 301 of the plate 300A may have a number of ports 302, each of which passes through the upper portion of the plate at an angle to a lower opening 303, with the lower openings spaced around the stem 304.

Figure 2A:
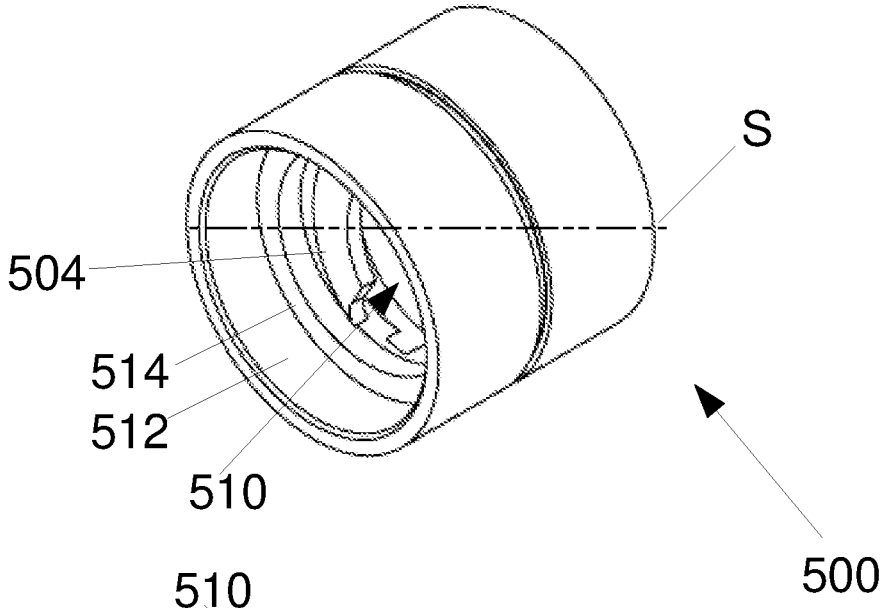
FIGS. 2A and 2B are perspective and sectional perspective views of the flow chamber of the tool of FIG. 1.
Figure 2B:
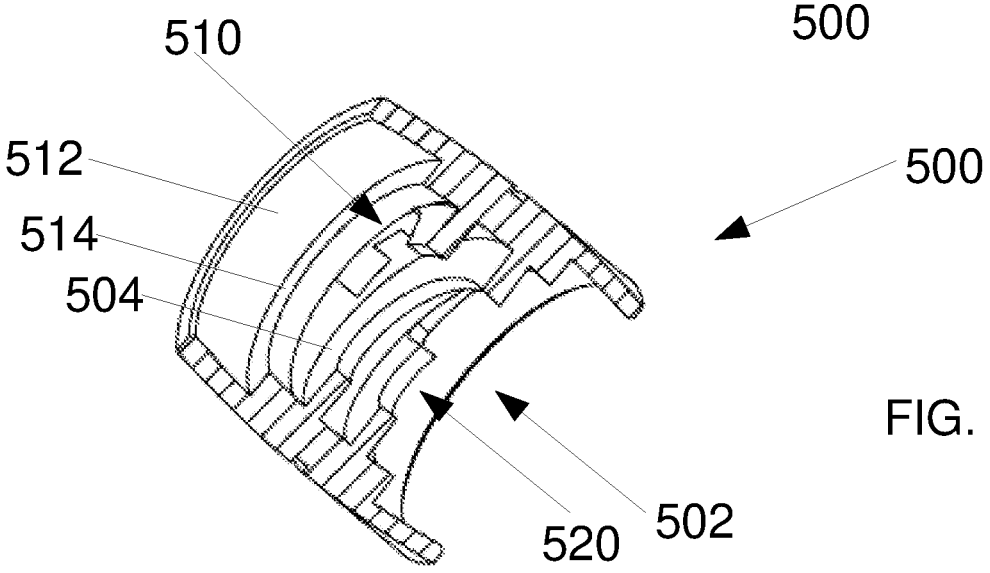

As depicted, in an assembled tool, the stem 304 of the upper flow plate 300A resides in the central channel 502 of the upper flow chamber 500A. A flow chamber 500, useful as upper flow chamber 500A is depicted in isolation in FIGS. 2A and 2B (which is a sectional view taken along line S in FIG. 2A).

As depicted, the central channel 502 passes from a first opening to a second opposite opening through the body of the flow chamber 500. A seat may be formed in the chamber at the first opening by the sidewall 512 and a ridge 514, which may be orthogonal thereto. At least one spiral channel 504 is disposed in the internal sidewall of the flow chamber 500. In the depicted embodiment, there are two spiral channels 504, each formed as a groove formed in the sidewall. At the seat, the spiral channel, may have a first opening 510 formed as a space in the ridge 514 and extend to a second opening 520 near the second end.

Upon insertion of the flow plate 300 into the first opening of the chamber 500 the stem 304 resides in central channel 502 to form an internal sidewall of the spiral channel(s) 504. The port(s) 302 may align with the first openings 510 into the spiral channel(s) which may spiral in a direction corresponding to the angle of the ports 302. The spiral channels and stem define a flow path through the flow chamber 500, with the ports 302 opening into the upper end of the flow path.

In the depicted embodiment, there are two spiral channels and ports shown, with, with a "right hand" helical spiral defined by the channels. It will be appreciated that the number of ports and the number of channels corresponding thereto may carry in different embodiment, depending on the intended use and the corresponding type of drilling fluid to be used, the flow volumes and viscosity of that fluid and the intended use of the tool.

During use, drilling fluid flows through top sub and passes into the ports 302 of the and through the spiral channels of the flow plate/flow chamber assembly to thereby exit the flow space defined by the flow plate and flow chamber with a spiral flow.

A vibration chamber 400 is disposed downstream of the upper flow plate 300A and upper flow chamber 500A. As depicted, the vibration chamber 400 may be formed as a tubular member having upper and lower openings to a central bore. The bore may have a uniform diameter and the sidewall of the body 402 may be formed with a sufficient thickness to allow its use as a portion of the vibration assembly. The vibration chamber 400 may have structures such as recessed portions 404 and channels 406 for installation of a seal to provide for sealed connections to the flow chambers 500. It will be appreciated that the particular sealing structures can vary in different embodiments.

At the upper end of the vibration chamber, the second end of the first flow chamber 500A opens into the central bore. At a lower end of the vibration chamber 400, a second or lower flow chamber 500B and flow plate 300B are disposed. These may be identical to the upper flow plate and flow chamber, only placed inverted such that flow space defined by stem 304 and the spiral channel 504 is open to the vibration chamber bore with the ports 302 downstream. Having part identity between the upper and lower flow chambers and flow plates may simplify manufacture by reducing the number of unique parts to be produced. Flow from the vibration chamber 400 thus exits the chamber in the same spiral pattern to maintain spiral flow of the drilling fluid through the chamber. The lower ends of the lower flow plate 300B and flow chamber 500B may reside on internal upset 1010 in the bore of the external housing 100.

The vibration assembly 1000 further includes a rotor 200. In the depicted embodiment, the rotor 200 may be a solid mass formed into a columnar shape with rounded edges which is disposed in the vibration chamber and sized for reciprocation therein. It will be appreciated that in other embodiments, the rotor shape may vary, and the rotor itself may be hollow or include one or more passages through it to produce particular vibration forces or speeds as may be useful for different tool applications.

It will be appreciated that although depicted as formed from separate components, including rotor 200, vibration chamber 400, flow chambers 500 and flow plates 300, the vibration assembly, or certain sub assembly components thereof, could be formed from an integral assembly. For example, the entire vibration assembly could be formed as an integrated unit using three-dimensional printing techniques, with the rotor initially attached to the remainder of the assembly by one or more small tabs, that could be broken by, or before, initial use to free it into motion. For such embodiments, the unit could be placed into a preexisting housing 100 for use or the complete tool 10 could be created during such process. In another exemplary embodiment, rather than being formed by a separate assembled the flow chamber 500 and flow plate 300, a spiral flow assembly could be formed by the three-dimensional printing of an integrated assembly having spiral flow channels opening from ports in a first planar surface and passing through the assembly to a second set of openings at a second surface.

It will be appreciated that in addition to three-dimensional printing, the various components can be constructed using suitable techniques as known to those of skill in the art and from suitable materials for the intended use.

Downstream from the vibration assembly, the central bore of housing 100 may continue through a narrowing portion 105. Lower internal threads 102 may be placed near the lower end to allow for attachment to a downstream fitting or tool, such as a drill bit assembly (generically indicated at DS2) in a drillstring assembly.

During use, drilling fluid flows from the top sub 600 into the ports 302 of the first flow plate 300A and into the flow space defined by the flow plate 300A and upper flow chamber 500A to enter a central vibration chamber in a spiral direction and exits the vibration chamber 400 through the counterpart flow space defined by the stem of the second flow plate 300B and second spiral flow chamber 500B maintaining the spiral flow (indicated by arrows SF) through the vibration chamber 400. The rotor 200 disposed in the vibration chamber 400 is caused to reciprocate around the vibration chamber, thereby creating vibrations that are transmitted to the drillstring.

The vibrations created by the reciprocation of the rotor 200 in the vibration assembly during use may be transmitted to the drillstring assembly. In practice, these transmitted vibrations created by a tool in accordance with the present disclosure to the drillstring have been shown to improve results in a number of drilling applications. In the case of exploratory core drilling, deploying the vibration tool in the downhole core retrieval assembly has been shown to improve rate of penetration as it assists with clearance of cuttings from the bit face to allow the drill bit to consistently make contact with virgin rock. Further, such tools have been shown to improve penetration and core recovery in broken or incompetent ground.

In another application, such a tool may be used to enhance reach of a drill-string both inside cased wellbore and open hole. For such use, a tool in accordance with the present disclosure is deployed in drillstring that is used in a well having cased wellbore (generically indicated by casing C in FIG. 1). Vibrations are created by the tool and transmitted to the drillstring as discussed previously herein. These vibrations are then further transmitted to the fluid present in the wellbore and create a resonance against the cased wall of the wellbore. This resonance vibration effectively breaks static friction between the drillstring and the wellbore, thus allowing the drillstring to be more easily deployed in extended reach applications.

While this disclosure has been described using certain embodiments, it can be further modified while keeping within its spirit and scope. This application is therefore intended to cover any variations, uses, or adaptations of the disclosure using its general principles. Further, this application is intended to cover such departures from the present disclosure as come within known or customary practices in the art to which it pertains, and which fall within the limits of the appended claims.

What is claimed is:

1. A downhole vibratory tool that uses fluid flow to reciprocate a rotor in a vibration chamber, comprising:

an elongated external housing with a top sub at an upstream end;

an upstream spiral flow assembly disposed within the elongated external housing to receive fluid flow from the top sub, the upstream flow assembly including at least one spiral path for fluid flow therethrough, the at least one spiral path extending from an upstream port to a downstream opening;

a vibration chamber disposed within the elongated external housing, wherein the upstream spiral flow assembly directs fluid through the spiral path into a first end an upstream portion of the vibration chamber as a spiral fluid flow;

a rotor disposed in the vibration chamber;

a downstream spiral flow assembly disposed within the elongated external housing at a downstream end of the vibration chamber opposite the upstream end, the downstream spiral flow assembly including at least one counterpart spiral path for fluid flow therethrough, wherein the downstream spiral flow assembly receives fluid through an upstream opening into the at least one counterpart spiral path to maintain the spiral fluid flow at a downstream portion of the vibration chamber; and a lower bore disposed within the elongated external housing to receive downstream fluid flow from the downstream spiral flow assembly.

2. The downhole vibratory tool of claim 1, wherein during use the spiral fluid flow through the vibration chamber causes the rotor to reciprocate around the vibration chamber to thereby create vibrations.

3. The downhole vibratory tool of claim 1, wherein the rotor is formed as a solid mass formed having a columnar shape with rounded edges.

4. The downhole vibratory tool of claim 1, wherein the rotor is detached from the remainder of the vibration chamber.

5. The downhole vibratory tool of claim 1, wherein the upstream spiral flow assembly comprises a plurality of spiral paths for fluid flow therethrough.

6. The downhole vibratory tool of claim 1, wherein the upstream spiral flow assembly has a planar top surface.

7. The downhole vibratory tool of claim 6, wherein the upstream spiral flow assembly comprises a flow plate with the planar top surface and a lower stem and a flow chamber having a central bore with a channel formed in a sidewall thereof and the at least one flow path is defined by the channel and the lower stem.

8. The downhole vibratory tool of claim 1, wherein the downstream spiral flow assembly has part identity to the upstream spiral flow assembly with an inverted installation to the vibration chamber.

9. A vibration assembly for a downhole vibratory tool, comprising:

an upstream spiral flow assembly designed to receive fluid flow in a downhole vibratory tool, the first upstream spiral flow assembly including at least one spiral path for fluid flow therethrough;

a vibration chamber comprising a chamber extending from an upstream end to a downstream end, the upstream end in fluid communication with the upstream spiral flow assembly, such that during use fluid flows through the upstream spiral flow assembly into an upstream portion of the vibration chamber as a spiral fluid flow;

a rotor disposed in the vibration chamber; and a downstream spiral flow assembly disposed at and in fluid communication with the downstream end of the vibration chamber, the downstream spiral flow assembly having part identity to the upstream spiral flow assembly with an inverted installation to the vibration chamber such that during use the second downstream spiral flow assembly receives fluid flow at the downstream end of the vibration chamber through an upstream opening into at least one counterpart spiral path for fluid flow therethrough.

10. The vibration assembly of claim 9, wherein the at least one spiral flow path and the at least one counterpart spiral flow path have a common flow direction to thereby maintain the spiral fluid flow from the upstream end to the downstream end of the vibration chamber.

11. The vibration assembly tool of claim 9, wherein during use the spiral fluid flow through the vibration chamber causes the rotor to reciprocate around the vibration chamber to thereby create vibrations.

12. The vibration assembly of claim 9, wherein the rotor is formed as a solid mass formed having a columnar shape with rounded edges.

13. The vibration assembly of claim 9, wherein the rotor is detached from the remainder of the vibration chamber.

14. The vibration assembly of claim 9, wherein the upstream spiral flow assembly comprises a plurality of spiral paths for fluid flow therethrough.

15. The vibration assembly of claim 9, wherein the upstream spiral flow assembly comprises a flow plate with a generally planar top surface with at least one port and a lower stem and a flow chamber having a central bore with a channel formed in a sidewall thereof and the at least one flow path is defined by the at least one port, the channel and the lower stem.

16. A method of transmitting vibrations to a drillstring using a downhole vibratory tool, the method comprising:

deploying a downhole vibratory tool containing a vibration assembly in a drillstring, wherein the vibration assembly comprises an upstream spiral flow assembly designed to receive fluid flow in a downhole vibratory tool, the upstream spiral flow assembly including at least one spiral path for fluid flow therethrough, the at least one spiral path extending from an upstream port to a downstream opening, a vibration chamber comprising a chamber extending from an upstream end to an opposite downstream end, the upstream end in fluid connection to the first upstream spiral flow assembly such that during use the first upstream spiral flow assembly directs fluid through the at least one spiral path into an upstream portion of the vibration chamber as a spiral fluid flow, a rotor disposed in the vibration chamber, a downstream spiral flow assembly in fluid connection to the downstream end of the vibration chamber such that during use the downstream spiral flow assembly receives the spiral fluid flow through an upstream opening into at least one counterpart spiral path for fluid flow to maintain the spiral fluid flow at a downstream portion of the vibration chamber;

flowing fluid through the drillstring and the downhole vibratory tool, such that fluid flows through the upstream spiral flow assembly to enter the vibration chamber in a spiral direction and to exit the vibration chamber through the downstream spiral flow assembly to create and maintain the spiral fluid flow through the vibration chamber to thereby cause the rotor to reciprocate around the vibration chamber and create vibrations that are transmitted to the drillstring.

17. The method of claim 16, wherein deploying the downhole vibratory tool comprises attaching the downhole vibratory tool to a drill bit assembly such that the created vibrations are directly transmitted to the drill bit assembly.

18. The method of claim 16, wherein deploying the downhole vibratory tool comprises deploying the drillstring containing the downhole vibratory tool into a cased wellbore and further comprises creating a resonance vibration in fluid within the wellbore to break static friction between the drillstring and the wellbore.

19. The method of claim 16, wherein deploying the downhole vibratory tool comprises deploying the downhole vibratory tool wherein the upstream spiral flow assembly comprises a flow plate with the generally planar top surface and a lower stem and a flow chamber having a central bore with a channel formed in a sidewall thereof and the at least one flow path is defined by the channel and the lower stem.

20. The method of claim 16, wherein deploying the downhole vibratory tool comprises deploying the downhole vibratory tool wherein the downstream spiral flow assembly has part identity to the upstream spiral flow assembly with an inverted installation to the vibration chamber.

* * * * *